US007931309B2

(12) United States Patent
Gebauer et al.

(10) Patent No.: US 7,931,309 B2
(45) Date of Patent: Apr. 26, 2011

(54) MODULAR COMPRESSED AIR MAINTENANCE UNIT

(75) Inventors: Günter Gebauer, Esslingen (DE); Robert Jachmann, Esslingen (DE)

(73) Assignee: Festo AG & Co. KG, Esslingen (DE)

( * ) Notice: Subject to any disclaimer, the term of this patent is extended or adjusted under 35 U.S.C. 154(b) by 337 days.

(21) Appl. No.: 12/223,153

(22) PCT Filed: Jan. 17, 2007

(86) PCT No.: PCT/EP2007/000349

§ 371 (c)(1),
(2), (4) Date: Jul. 23, 2008

(87) PCT Pub. No.: WO2007/093257

PCT Pub. Date: Aug. 23, 2007

(65) Prior Publication Data

US 2010/0225105 A1 Sep. 9, 2010

(30) Foreign Application Priority Data

Feb. 16, 2006 (DE) ..... 10 2006 007 103

(51) Int. Cl.
*F16L 23/00* (2006.01)

(52) U.S. Cl. ..... 285/364; 285/93; 285/124.5

(58) Field of Classification Search ..... 285/124.5, 285/124.3, 124.2, 93
See application file for complete search history.

(56) References Cited

U.S. PATENT DOCUMENTS

| | | | | |
|---|---|---|---|---|
| 4,289,335 | A * | 9/1981 | Olbermann | 285/91 |
| 4,352,511 | A * | 10/1982 | Ribble et al. | 285/91 |
| 4,533,020 | A * | 8/1985 | Yamazaki | 285/325 |
| 5,372,392 | A * | 12/1994 | Dunn et al. | 285/334.1 |
| 5,383,689 | A * | 1/1995 | Wolfe, Sr. | 285/124.3 |
| 5,901,984 | A * | 5/1999 | Nishikawa | 285/93 |
| 6,039,358 | A * | 3/2000 | Stoll et al. | 285/23 |
| 6,609,679 | B1 * | 8/2003 | Seidel | 248/222.13 |
| 6,913,115 | B2 | 7/2005 | Tomita et al. | |
| 7,146,999 | B2 * | 12/2006 | Giese et al. | 285/124.5 |
| 7,300,075 | B2 * | 11/2007 | Ebskamp et al. | 285/124.5 |
| 2003/0006097 | A1 | 1/2003 | Tomita et al. | |

FOREIGN PATENT DOCUMENTS

| | | |
|---|---|---|
| DE | 40 32 515 | 4/1992 |
| DE | 295 09 073 | 11/1996 |
| EP | 0 909 898 | 4/1999 |

* cited by examiner

*Primary Examiner* — David E Bochna
(74) *Attorney, Agent, or Firm* — Hoffmann & Baron, LLP

(57) ABSTRACT

A compressed air servicing device comprises several device modules (3) arranged in a row direction (2) and connected detachably with each other. At least two device modules (3) are detachably connected together by a module connector (4) placed between them, the module connector (4) having a through opening (14) by way of which the two device modules (3) are connected for fluid flow with one another. The module connector (4) is fitted with at least one sensor (15) connected with the through opening (14), such sensor (15) making possible monitoring of status data with respect to the flowing compressed air.

20 Claims, 3 Drawing Sheets

MODULAR COMPRESSED AIR MAINTENANCE UNIT

This application claims priority based on an International Application filed under the Patent Cooperation Treaty, PCT/EP2007/000349, filed Jan. 17, 2007 and German patent Application No. DE102006007103.4, filed Feb. 16, 2006.

BACKGROUND OF THE INVENTION

The invention relates to a modular compressed air servicing device comprising several device modules arranged in a row direction and detachably joined together, at least two device modules being detachably attached to one another by a module connector placed between them, such module connector having a through opening connecting the two modules with each other for fluid flow.

Compressed air servicing devices are generally employed to prepare or treat compressed air employed in pneumatic equipment in accordance with certain criteria. They may comprise different types of device modules which possess different functionalities, for example switching on valve modules, filter modules, oiler modules, pressure regulating modules and venting modules or the like.

In accordance with the German patent publication DE 40 32 515 A1, the U.S. Pat. No. 6,913,115 or the German patent publication DE 295 09 073 U1 which respectively show a compressed air servicing device of the type initially mentioned, the different device modules are arranged in a row direction and are detachably and firmly connected together by module connector between two respective adjacent device module so that there is a self-contained subassembly. Each module connector comprises a perforated intermediate plate, whose through opening provides a fluid connection between the adjacent device modules so that there is a compressed air duct extending through all device modules. The compressed air to be treated is supplied through a compressed air inlet as it comes from a compressed air source, into the compressed air servicing device and leaves again after flowing through all device modules in the desired treated form at a compressed air outlet again. Thence the treated compressed air flows to one or more loads.

During operation of a compressed air servicing device it is now and again desirable to receive information with respect to the condition of the air flowing through the compressed air servicing device, for example pressure information. On the basis of such information the proper manner of functioning of the servicing device may be monitored. As may be seen from the product catalog "Der Pneumatic-Katalog 97/98" 33rd edition of FESTO AG & Co, Ruiter Straβe 82, D-73734 Esslingen, Germany, page 9.1/31 it is a standard practice today for pressure monitoring within a compressed air servicing device to be effected by providing an additional device module in the form of a distributor block, which is furnished with a pressure switch. This involves and extension in length of the compressed air servicing device, because it is then fitted with a larger number of device modules than the desired treatment of the compressed air actually requires. Alternatively it would also be conceivable to install the pressure switch with the use of a suitable adapter instead of a manometer on a pressure regulating module. This would however mean that there would be no optical pressure display by a manometer.

SUMMARY OF THE INVENTION

One object of the present invention is to provide a modular compressed air servicing device which while still having compact dimensions and using relatively simple means renders possible condition monitoring of the compressed air.

In order to achieve this aim the module connector employed for joining two adjacent device modules is provided with at least one sensor means connected with its through opening.

Dependent on the particular design the compressed air servicing device will comprise two or more device modules. In the case of only two device modules the module connector connecting these device modules is designed in accordance with the invention. In the case of more than two device modules, dependent on requirements, only one or more or all connections of two adjacent device modules may be in the form of one module connector designed in accordance with the invention. In every case the respective module connector performs a twin function, since it is not only responsible for the mechanical coupling of two adjacent device modules but also simultaneously serves as a support for at least one sensor means. Accordingly a component, which is in any case present (the module connector), is utilized as well for condition monitoring as regards the compressed air flowing through the compressed air servicing device. The device modules present may accordingly still be employed in a conventional fashion and without upgrading and the incorporation of additional device modules serving for monitoring the status of the compressed air is unnecessary. Since the sensor means is connected with the through opening in the module connector fitted with it, no concatenation with any device modules is required to perform the desired evaluation. However the module connector could, if there is a corresponding electronic configuration, also have interface means, which allow a connection with an internal bus of the compressed air servicing device.

The kind of the sensor means present is orientated on the requirement for monitoring. It may for example be a question of a pressure sensor means, a flow rate sensor means, a temperature sensor means or a moisture sensor means, one and the same module connector possibly being fitted at the same time with several different sensor means and there also being the possibility that within one servicing device several module connectors are provided on sensor means and have mutually different configurations.

To the extent that the module connector is designed that it is functionally able to be combined with servicing devices which are already commercially available, it will also be suitable for economic upgrading of existing compressed air servicing devices.

Further advantageous developments as regards the modular compressed air servicing device are defined in the dependent claims.

The connection of the at least one sensor means with the through opening of the module connector is preferably by way of at least one tapping duct extending through the module connector, and preferably extending in a plane at a right angle to the row direction of the device modules. In accordance with the particular sort of sensor means a single tapping duct may suffice, for example for plain pressure detection, or several tapping ducts can be reasonable or essential, for example ducts responsive to the flow rates of compressed air in accordance with the differential pressure principle.

The at least one sensor means is preferably arranged at the outer face, set perpendicularly to the row direction, of the associated module connector. Accordingly it is readily accessible from the side of the compressed air servicing device. As related to the installation position of the compressed air servicing device the sensor means may in this case be placed at the top, at the bottom, to the front or on the back side as may be required.

As compared with a simple installation of the sensor means on the module connector an integration offers the advantage that the overall volume present of the module connector may be utilized in order to ensure space-saving accommodation. There is more particularly the possibility of completely or partially accommodating the sensor means in a pocket in part of the outer face of the module connector.

A configuration of the sensor means with electrical interface means renders possible simple communication with an external electrical evaluation means. Therefore no additional interfaces will be necessary on the device modules.

A configuration of the sensor means with optical display means, for example with one or more LEDs and/or an LCD monitor renders possible effective inspection on site. If required it is also possible to have manually operated input means, for example to teach a correspondingly configured sensor means. In addition or alternatively the sensor means may also comprise acoustic signal means in order to draw the attention of machine minders to certain events.

In the case of a particularly advantageous embodiment of the invention the module connector comprise an intermediate plate having the through opening with a plate plane normal to the row direction between the device modules to be connected, such intermediate plate being flanked in an actuation direction normal to the row direction by a respective actuating body of the module connector on opposite sides. The actuating bodies are so designed that they may cooperate with associated holding sections of the device modules to be coupled, such cooperation preferably being aided by bracing means, for example in the form of one or more bracing screws.

By means of the bracing means it is possible for the actuating bodies may be operated so as to press them toward one another, same being so thrust against the holding sections that the device modules are braced together in the row direction, same bearing against the intermediate plate from opposite sides.

It is more particularly expedient in this context to provide an embodiment in the case of which an actuating body is combined with the intermediate plate to form a structural unit which may be termed an actuating unit, more particularly in an integral design.

For the accommodation of the at least one sensor means it is more particularly possible to use at least one of the actuating bodies, although in principle it would also be possible to configure the intermediate plate with at least one sensor means. If an actuation unit is present, then the sensor means will preferably located on or in the separate actuating body.

BRIEF DESCRIPTION OF THE DRAWINGS

In the following the invention will be explained in detail with reference to the accompanying drawings.

DETAILED DESCRIPTION OF THE PREFERRED EMBODIMENTS

Figure 1:
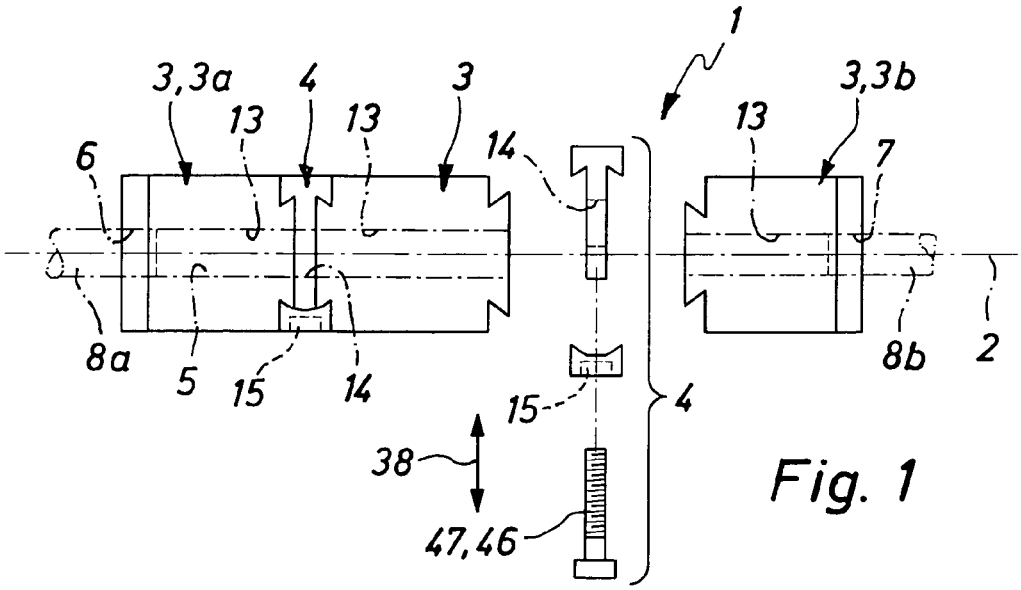
FIG. 1 shows a preferred embodiment of the compressed air servicing device in plan view in a highly diagrammatic form, one module connector being illustrated in the installed state and one other module connector being illustrated in the condition prior to installation.

The modular compressed air servicing device generally referenced 1 comprises several device modules 3 arranged in a row direction 2 in sequence, of which the respectively directly following device modules being connected by a module connector 4 in a detachable fashion. The device modules 3 and the module connectors 4 thus constitute a self-contained structural unit in the form of the compressed air servicing device 1.

Through the servicing device 1 there extends a compressed air duct 5 opening to the terminal device modules 3 and 3*a* and 3*b*, to wit in the one case with a compressed air inlet 6 and in the other case at a compressed air outlet 7. These two connections 6 and 7 may in principle be placed and orientated in any suitable way, same being located in the working embodiment on the two end faces, orientated in the row direction 2, of the device modules 3*a* and 3*b* respectively terminating the module arrangement.

The compressed air inlet 6 and the compressed air outlet 7 are respectively designed for the connection of a compressed air line 8*a* and 8*b*, preferably detachably. These compressed air lines 8*a* and 8*b* will regularly be a component of a line system laid at the site of the of use of the compressed air servicing device 1. During operation of the compressed air servicing device 1 the latter receives untreated compressed air by way of the one compressed air line 8*a*, such compressed air being able to be supplied to one or more connected loads via the other compressed air line 8*b* in the required treated form after flowing through the compressed air duct 5, which extends through the servicing device 2. The compressed air inlet 6 and the compressed air outlet 7 may for example be provided with thread means and/or plug connection means for the connection of the compressed air lines 8*a* and 8*b*.

The compressed air duct 5 is made up of several duct sections 13 extending in the individual device modules 3, such sections 13 being connected together in a sealing manner on assembly of the device modules 3 and together constituting the compressed air duct 5.

Figure 4:
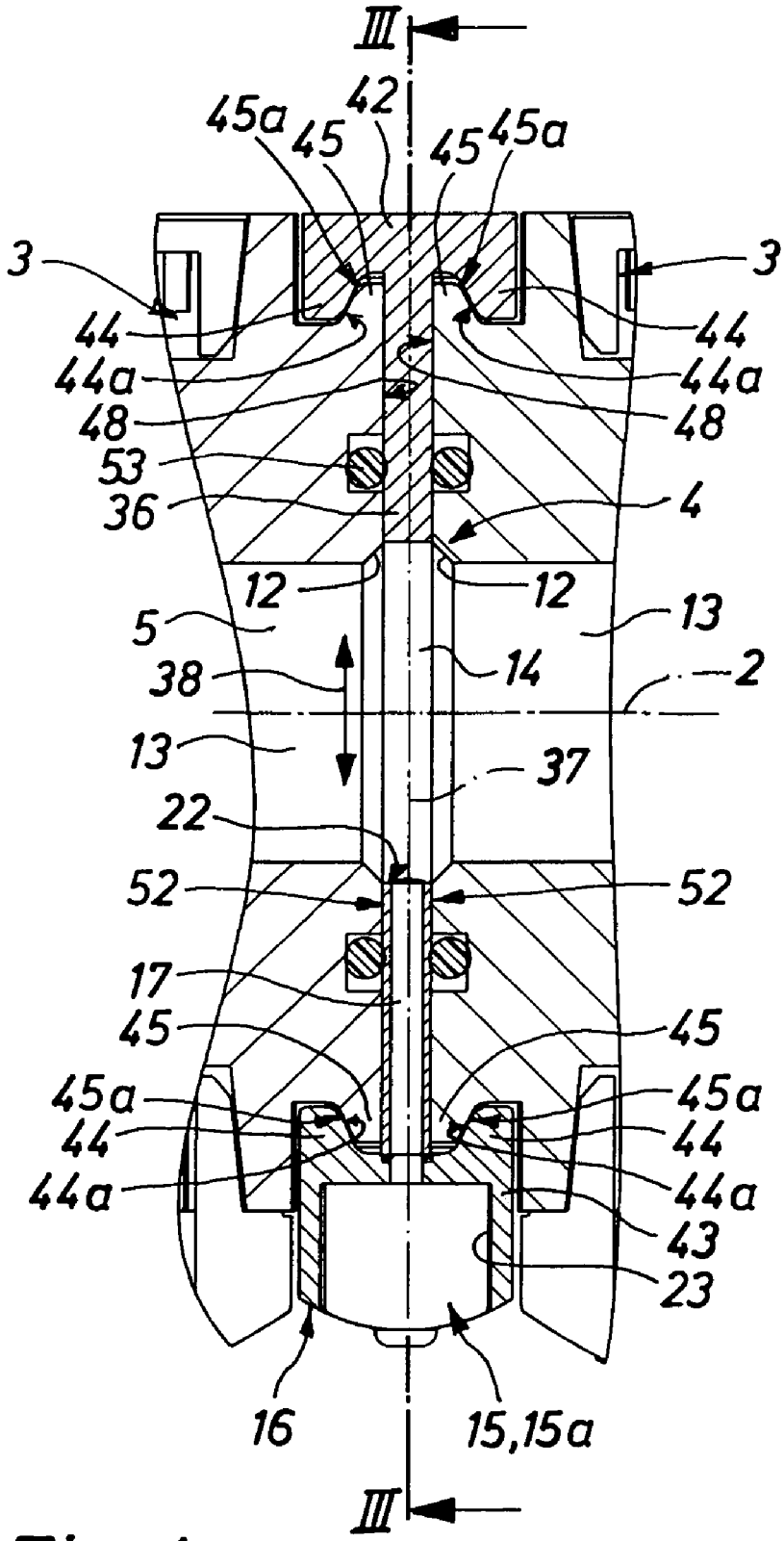
FIG. 4 is a section taken through the arrangement of FIGS. 2 and 3 on the section line IV-IV in a section plane turned through 90 degree out of the plane of FIG. 3, the mutually facing end sections of both device modules being visible, which are mechanically coupled together.

As shown in FIG. 4 in the assembled state the duct openings 12 of the duct sections 13 of two sequentially following of device modules 3 are opposite each other in an aligned manner. The module connector 4 placed between the device modules 3 possesses a through opening 14 extending in the row direction 2, such opening 14 assuming a position coaxially between the two duct openings 12 and having a cross section which is at least as large as that of the above mentioned duct openings 12 in order to ensure free flow of the compressed air.

Figure 2:
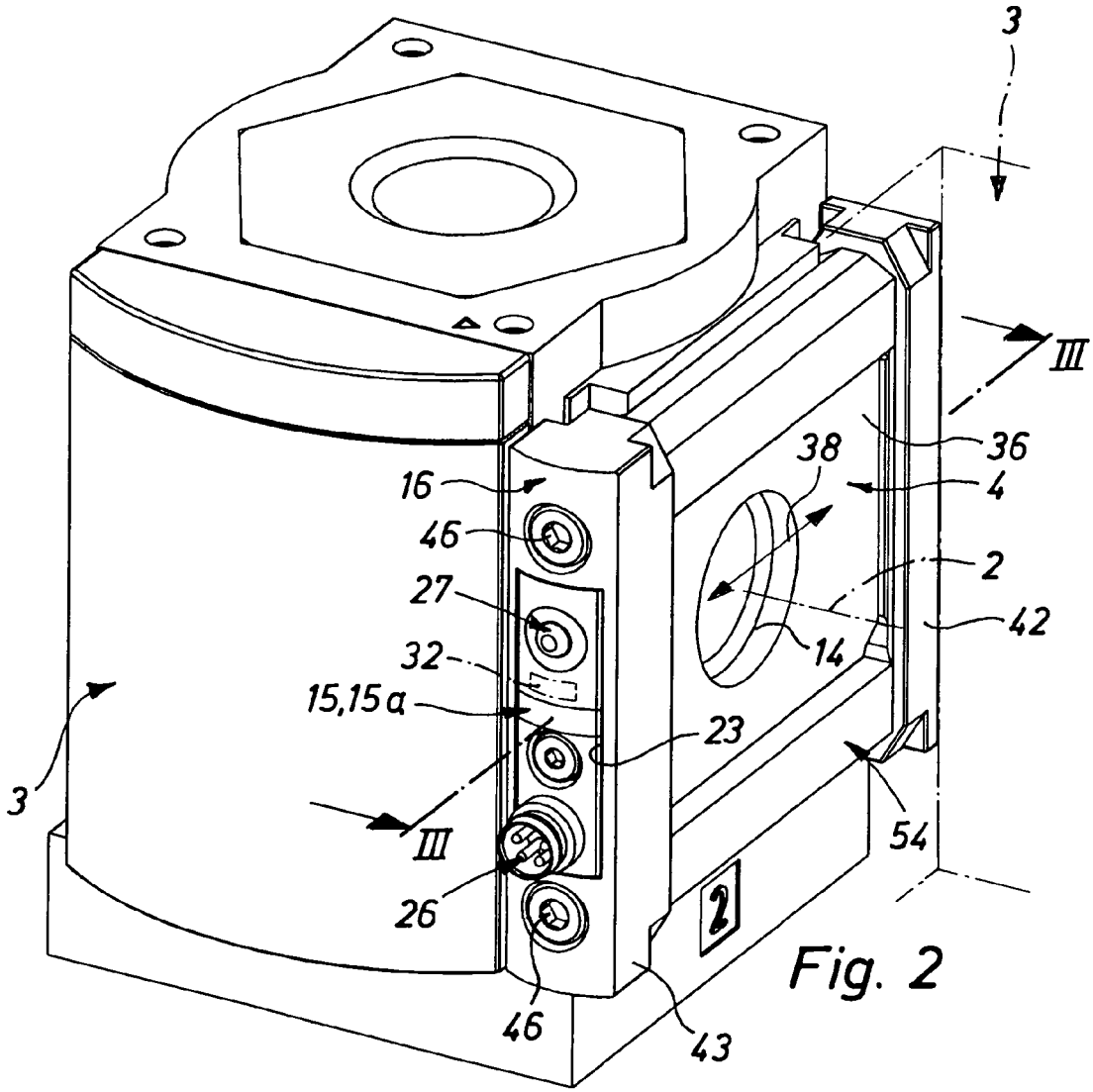
FIG. 2 is a separate showing of a device module of the compressed air servicing device of FIG. 1 in a perspective separate elevation in the installed state of a module connector, the second device module cooperating with this module connector being indicated only in chained lines for clarity.

The number, type and order of the device modules 3 collected together in the compressed air servicing device 1 is in principle unrestricted and will be orientated in accordance with the requirements of the respective user. As shown in FIG. 1 it is a question for example of a switching on valve module, and a following pressure regulating module which is followed by a filter module. The pressure regulating module is represented in FIG. 2 as a whole. It is also to be seen from FIG. 2, and FIGS. 3 and 4 as well, that there is the pressure regulating module with the following filter module coupled by the module connector 4.

The device module 3 designed as the switching on valve module comprises an electrically or manually worked shut down valve means (not illustrated in detail), by which flow through the compressed air duct 5 can be selectively shut off or turned on. Using the pressure regulating module it is possible for the pressure of the compressed air to be set to a working pressure level less than the input pressure. The filter module possesses a filter means for filtering out foreign matter from the compressed air.

The two module connectors 4 present in the working example are identical in design so that the further description may be restricted to one thereof.

These two module connectors 4 and accordingly all module connectors 4 of the compressed air servicing device 1 are provided with a sensor means 15, which is connected within the module connector 4 with a through opening 14 of the respective module connector 4 and accordingly is in position to detect status data in the compressed air flowing via the compressed air duct and possibly processing and/or evaluating such data.

The sensor means 15 is a pressure sensor means 15*a* in the case of both working embodiments. Accordingly in the working example the input pressure upstream from the pressure regulating module and the output pressure downstream from the pressure regulating module may be monitored. This renders possible monitoring of the correct function of the pressure regulating module or also taking other diagnostic measures.

The module connectors 4 possess generally a disk-like or plate-like flat form and are accordingly sandwiched between adjacent device modules 3 so that their principal direction of extent is at a right angle to the row direction 2. They therefore possess a relatively narrow encircling edge, which defines the outer face 16, radially orientated in relation to the row direction 2, of the module connector 4. The sensor means 15 is preferably placed at such outer face 16 and is consequently readily accessible even when the module connector 4 is installed from the side of the compressed air servicing device 1.

For tapping pressure in the through opening 14 the module connector 4 comprises a first tapping duct 17, which is connected on the one hand with the sensor means 15 and on the other hand the through opening 14. The connection with the through opening 14 is simply effected since the first tapping duct 17 opens at the peripheral wall 33 of the through opening 14 into the same.

For other kinds of sensor means 15 it may be appropriate or mandatory to provide one or more further tapping ducts in the module connector 4. This is indicated in a representation fashion in FIG. 3 in chained lines in the form of a second tapping duct 18, which opens into the through opening 14 in the row direction 2 at a distance from the first tapping duct 17 so that in conjunction with means (not illustrated in detail) causing a pressure drop in the compressed air flowing through a pressure difference may be measured, which may be employed in a flow rate sensor means to find the compressed air flow rate.

Figure 3:
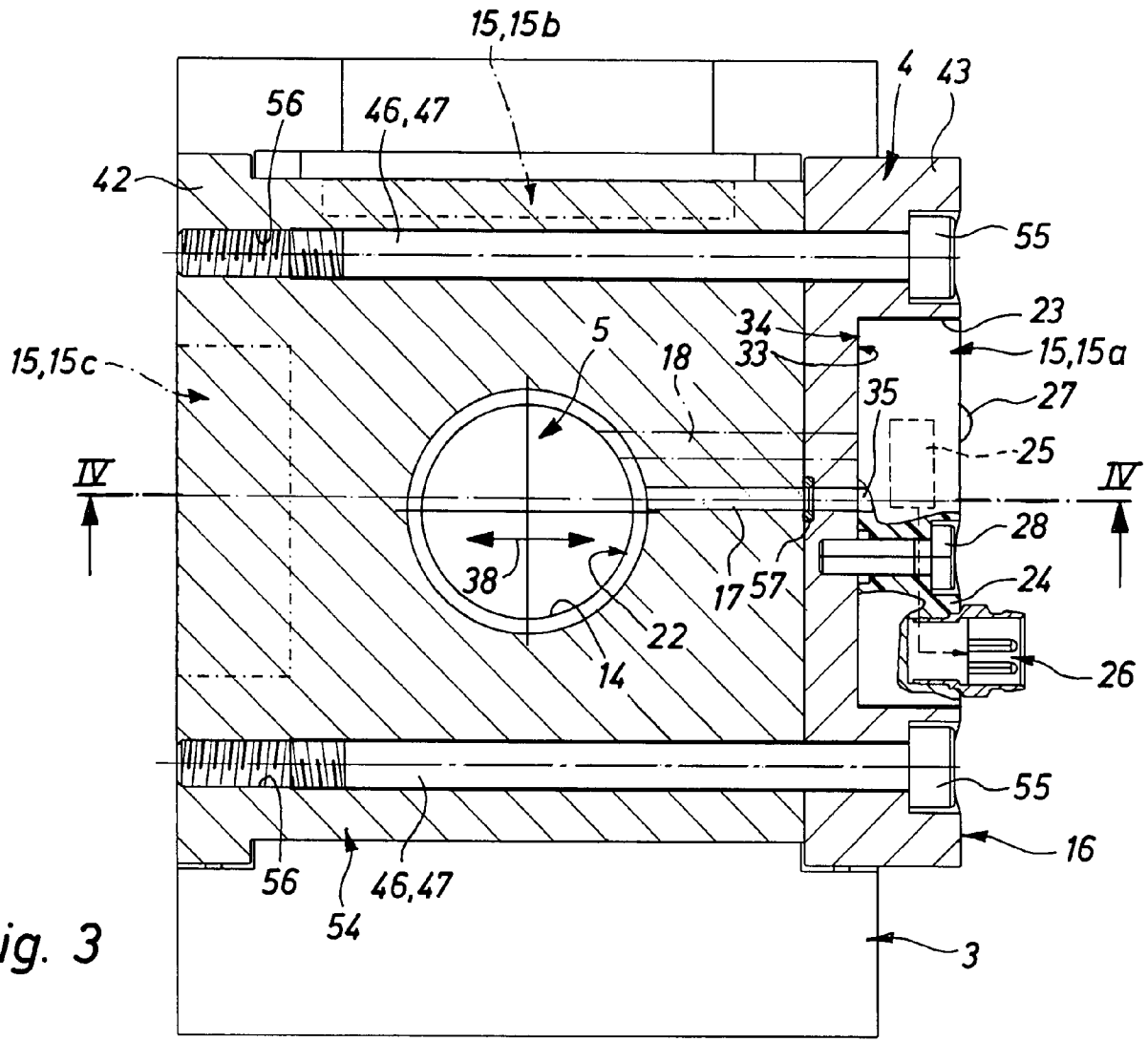
FIG. 3 is a section taken through the module connector on the section line III-III in FIGS. 2 and 4 in a section plane normal to the row direction of the device modules.

In the present example in FIG. 3 two further sorts of possible sensor means 15 are indicated in chained lines, i.e. on the one hand a temperature sensor means 15*b* and on the other hand a moisture sensor means 15*c*. The former is for monitoring the temperature of the flowing compressed air whereas the other is for monitoring the relative moisture of the compressed air. The connection with the through opening 14 is also in this case effected using at least one tapping duct, which in the drawing is however not illustrated.

In accordance with the measurement principle employed it is possible to produce a fluid connection, by way of the at least one tapping duct 17 and 18, with the respective sensor means 15 or at least one electrical conductor runs in the tapping duct, the remaining cross section of the duct then being filled, if required, by potting resin. The latter provision will apply more particularly for temperature detection using a thermo element arranged in the through opening 14.

In order to manufacture the module connector 4 in a particularly simple manner the at least one tapping duct 17 and 18 preferably always extends in a plane normal to the row direction 2, more especially in a straight line all along it.

In principle it is possible for the sensor means 15 to be arranged externally on the outer face 16. This form of design will mostly be chosen for compressed air servicing devices 1 for low flow rates, in the case of which the overall volume of the module connector 4 is insufficient to accommodate the sensor means 15.

The drawing shows an advantageous modification in design, in the case of which the sensor means 15 is accommodated in a pocket 23, open toward the outer face 16, in the module connector 4.

The sensor means 15 is preferably in the form of a compact sensor unit with a sensor housing 24 preferably made of synthetic resin, which accommodates the required electronic and mechanical sensor means 25. The sensor means 15 designed in this fashion is in the working example let into the pocket 23, which is essentially complementary in form, and in the working example only has its electrical interface means 26 and to a slight extent its optical display means 27 protruding from the pocket.

By means of at least one attachment screw 28 extending through the sensor means 15 the latter is detachably secured on the module connector 4. Other attachment means would also be possible. For instance, the sensor means 15 could be held on the module connector 4 by the intermediary of an adhesive bond on the module connector 4.

The electrical interface means 26 renders possible an electrical connection of the sensor means 15 with an external electronic control means, which is in a position of processing the generated sensor signals. Accordingly it is possible for example in the case of there being an unexpected condition of the compressed air for a warning signal to be generated or a switching on valve module may be changed into the turned off condition, if there is a threat of damage. The optical display means 27 render possible a visual inspection of the status display. In this case it will for example be a question of an LED with a surrounding light guide. Alternatively or in addition an LCD monitor may be present.

The sensor means 15 may also be only provided with diagrammatically indicated manually worked input means 32, as for example one or more key elements. Given a suitable design of the sensor means 15 this for example renders possible the input of threshold values, at which the sensor means 15 is to trigger a certain action.

Preferably the at least one tapping duct 17 and 18 opens at its end opposite to the through opening 14 at its base face 33 of the module connector 4, with which the installed sensor means 15 its bottom face 34 in engagement. At such bottom face 34 there opens a number, equal to the number of the tapping ducts 17 and 18, of measurement ducts 35, which run in the sensor housing 24 and lead to the sensor means 25. In the installed state of the sensor means 15 the measurement ducts 15 communicate in the proper association with the tapping ducts 17 and 18, which open at aligned openings at the bottom face 33. This bottom face 33 is more particularly the bottom of the pocket 23.

Sealing means, not illustrated in detail, serve to provide for a sealed joint between the measurement ducts 35 unit tapping ducts 17 and 18. They are preferably a component of the sensor means 15.

The particularly advantageous module connector 4 comprises an intermediate plate 36 fitting between the device modules 3 to be connected, such plate being so aligned that its plane 37 is perpendicular to the row direction 2. It is perforated, more particularly centrally, the preferably circularly round hole constituting the above mentioned through opening 14.

As related to an actuating direction 38 indicated by double arrow and extending in parallelism to the plate plane 37 and perpendicularly to the row direction 36 the intermediate plate 36 is flanked on opposite sides by a respective actuating body 42 and 43. The latter possess an essentially beam-like configuration with a longitudinal extent in the plate plane 37 and perpendicularly to the direction 38 of actuation. Their width as measured in the row direction 2 is preferably larger than that of the intermediate plate 36.

Both actuating bodies 42 and 43 possess a respective actuating shape 44 or outline in the row direction 2 on either side of the intermediate plate 36. The actuating shape 44 has at least one first oblique face 44*a* slanted in relation to the plate plane 37, which faces the intermediate plate 36, but whose distance from the plate 36 increases nearer the through opening 14.

Each actuating shape 44 cooperates with a holding section 45 arranged on the associated device module 3. This section defines a second oblique face 45*a* with the same slant as the first oblique face 44*a*, albeit with an orientation directed away from the intermediate plate 36.

The two actuating bodies 42 and 43 are now so able to be placed on the device modules placed together with the intermediate plate 36 sandwiched between them that their first oblique faces 44*a* hook around the second oblique faces 45*a* in the row direction 2.

By bracing means 46 of the module connector 4 it is possible ☺ for the two actuating bodies 42 and 43 to be loaded in the actuation direction 38 with a mutual movement together. The bracing means 46 may for example consist of two bracing screws 47, which are spaced apart athwart the actuation direction 38, extending in the actuation direction 37. A different number of bracing screws 47 would also be conceivable.

The actuating bodies 42 and 43 braced together have their actuation shapes 44 acting on the holding sections 45 and accordingly thrust against the device modules 3 in a such manner that the same are subjected to a setting force with the effect of a movement together. This means that the device modules 3 have their mutually facing end faces 48 thrust against the respectively facing plate face 52 of the intermediate plate 36. The intermediate plate 36 is accordingly firmly squeezed between the two device modules. Accordingly there is generally a firm connection between the two device modules 3.

The two plate faces 52 are in the form of sealing faces around the aperture of the through opening 14, with which a sealing ring 53 is in engagement. The sealing ring 53 is seated in an axially open annular groove in the end face 48, it surrounding the associated duct opening 12 so that the joint face between the intermediate plate 36 and the respectively associated end face 48 is sealed off and in the joint part of the device modules 3 no compressed air may escape.

Preferably the one, first actuating body 42 and the intermediate plate 36 are collected together as a preferably one piece structural unit, which will be termed the actuation unit 54. The bracing screws 47 extending in the actuation direction 38 respectively extend through the separate second actuating body 43, against which their heads 55 bear, and they extend within the actuation unit 54, into which they are screwed in a female thread 56.

The position of placement for the female thread 56 is in principle quite unrestricted. If on the contrary two separate actuating bodies 42 and 43 are present, the female threads 56 will be inside the first actuating body 42.

The sensor means 15 is located in the working example on or in the separate second actuation body 43. In the case of one preferred working alignment of the compressed air servicing device 1 the row direction and the actuation direction 38 extend horizontally, the second actuation body 43 fitted with the sensor means 15 being placed more particularly on the front side.

More particularly in a manner dependent on the position of use it is possible for one or more sensor means 15 also to be arranged on or in the module connector 4. In the working example of the invention FIG. 3 shows an additional or alternative configuration in chained lines of the first actuation body 42 with a sensor means 15 and 15*c*, and furthermore a configuration of the intermediate plate 36 which one sensor means 15 and 15*b*.

As related to the position of use of the compressed air servicing device 1 it is possible for a sensor means 15 to be located more particularly on the front side, on the back side, on the bottom side on the top side of the module connector 4.

If there is a sensor means 15, as depicted in FIG. 3, on or in the separate second actuation body 43, there is a division of the at least one tapping duct 17 and 18 into two duct sections, of which the one extends in the intermediate plate 36 and the other runs in the second actuation body 43. In the transitional zone between these two components the duct section openings are in line opposite each other and are delimited by a sealing ring 57, which avoids escape of compressed air to the outside.

Within a compressed air servicing device 1 of the module connectors 4 present respectively one, several or all can be configured in the manner in accordance with the invention with a sensor means 15. There is accordingly furthermore the possibility also of using conventional module connectors 4, which are not fitted, or capable of being fitted, with a sensor means 15, jointly in one and the same compressed air servicing device 1.

Owing to the combination of the sensor means 15 with a module connector 4 economical monitoring and diagnosis is possible. Use may take place with an orientation in accordance with applications and in an extremely adaptable fashion. Additional interfaces on the device module are unnecessary and furthermore no special further device modules are required. For the sensor means 15 practically any functionalities may be conceived, more particularly also as a pressure sensor with a window comparator function.

Instead of the electrical interface means 26 connected by wiring a wireless interface would also be possible, in particular a radio interface means.

If the compressed air servicing device 1 comprises further electrical and/or electronic components, a data bus extending in the row direction may be present with which the sensor means 15 as well may be coupled. In this case the module connector 4 will preferably possess an electrical interface rendering possible connection with this internal bus.

The invention claimed is:

1. A modular compressed air servicing device comprising several device modules arranged in a row direction and detachably joined together, at least two device modules being detachably attached to one another by a module connector placed between them, such module connector having a through opening connecting the two device modules with each other for fluid flow, wherein the module connector is fitted with at least one sensor means connected to the through opening, and wherein the module connector is in the form of a plate having opposite major planar surfaces and a relatively narrow peripheral encircling edge, the opposite major planar surfaces having a principal direction of extent at a right angle to the row direction and the encircling edge defining an outer face of the modular connector radially orientated in relation to the row direction, and wherein the through opening extends between the opposite major planar surfaces and the sensor means is disposed on the encircling edge.

2. The compressed air servicing device as set forth in claim 1, wherein the device comprises more than two device modules joined together, a module connector, which is fitted with at least one sensor means, being placed between the device modules of only one or several pairs of device modules.

3. The compressed air servicing device as set forth in claim 1, wherein at least one module connector is fitted with a pressure sensor means.

4. The compressed air servicing device as set forth in claim 1, wherein at least one module connector is fitted with a flow rate sensor means.

5. The compressed air servicing device as set forth in claim 1, wherein at least one module connector is fitted with a temperature sensor means.

6. The compressed air servicing device as set forth in claim 1, wherein the at least one module connector is fitted with a moisture sensor means.

7. The compressed air servicing device as set forth in claim 1, wherein the at least one sensor means is connected with the through opening via at least one tapping duct extending through the module connector and opening into the through opening at the peripheral wall thereof.

8. The compressed air servicing device as set forth in claim 1, wherein the at least one tapping duct extends in a plane perpendicular to the row direction.

9. The compressed air servicing device as set forth in claim 1, wherein the at least one sensor means is arranged in the region of the outer face, orientated perpendicularly to the row direction, of the associated module connector.

10. The compressed air servicing device as set forth in claim 9, wherein the at least one sensor means is received in a pocket, open at the outer face, in the module connector.

11. The compressed air servicing device as set forth in claim 1, wherein the sensor means possesses electrical interface means, manually operated input means and/or optical display means arranged in the region of the outer face, which is normal to the row direction, of the associated module connector.

12. The compressed air servicing device as set forth in claim 1, wherein the sensor means possesses acoustic signal means.

13. The compressed air servicing device as set forth in claim 1, wherein the module connector possesses an intermediate plate which extends between the device modules to be connected and is perforated to form the through opening, such intermediate plate having a plate plane normal to the row direction.

14. A modular compressed air servicing device comprising several device modules arranged in a row direction and detachably joined together, at least two device modules being detachably attached to one another by a module connector placed between them, such module connector having a through opening connecting the two device modules with each other for fluid flow, wherein the module connector is fitted with at least one sensor means connected to the through opening, and wherein the module connector possesses an intermediate plate which extends between the device modules to be connected and is perforated to form the through opening, such intermediate plate having a plate plane normal to the row direction, and wherein, at its mutually opposite face, the intermediate plate has a respective sealing face extending around the aperture, located here, of the through opening and against such sealing face a sealing ring rests which is arranged in an axially orientated annular groove in the adjacent device module.

15. A modular compressed air servicing device comprising several device modules arranged in a row direction and detachably joined together, at least two device modules being detachably attached to one another by a module connector placed between them, such module connector having a through opening connecting the two device modules with each other for fluid flow, wherein the module connector is fitted with at least one sensor means connected to the through opening, and wherein the module connector possesses an intermediate plate which extends between the device modules to be connected and is perforated to form the through opening, such intermediate plate having a plate plane normal to the row direction, and wherein the intermediate plate, in an actuation direction which is normal to the row direction, is flanked on opposite sides by a respective actuation body of the module connector, said actuation bodies being in engagement simultaneously with holding sections of both adjacent device modules, the two actuation bodies being braced together by bracing means of the module connector in the actuation direction and accordingly the two device modules are braced onto the intermediately placed intermediate plate.

16. The compressed air servicing device as set forth in claim 15, wherein the bracing means include at least one bracing screw extending in the actuation direction.

17. The compressed air servicing device as set forth in claim 15, wherein the intermediate plate and one of the actuation bodies form an integral actuation unit.

18. The compressed air servicing device as set forth in claim 15, wherein at least one of the actuation bodies is fitted with said at least one sensor means.

19. The compressed air servicing device as set forth in claim 18, wherein, in the case where said one sensor means is arranged on an actuation body separate from the intermediate plate, a tapping duct extending between the sensor means and the through opening runs partly in the actuation body and partly in the intermediate plate, and in the transitional zone between these components a seal is arranged.

20. The compressed air servicing device as set forth in claim 15, wherein the intermediate plate is provided with said at least one sensor means.

* * * * *